US009251950B2

(12) United States Patent
Hatanaka et al.

(10) Patent No.: US 9,251,950 B2
(45) Date of Patent: Feb. 2, 2016

(54) MAGNETIC ELEMENT FOR WIRELESS POWER TRANSMISSION AND METHOD FOR MANUFACTURING SAME

(75) Inventors: Takezo Hatanaka, Ibaraki (JP); Chisato Goto, Ibaraki (JP)

(73) Assignee: NITTO DENKO CORPORATION, Ibaraki (JP)

( * ) Notice: Subject to any disclaimer, the term of this patent is extended or adjusted under 35 U.S.C. 154(b) by 0 days.

(21) Appl. No.: 14/005,502

(22) PCT Filed: Mar. 6, 2012

(86) PCT No.: PCT/JP2012/055680

§ 371 (c)(1),
(2), (4) Date: Sep. 16, 2013

(87) PCT Pub. No.: WO2012/128027

PCT Pub. Date: Sep. 27, 2012

(65) Prior Publication Data

US 2014/0002228 A1 Jan. 2, 2014

(30) Foreign Application Priority Data

Mar. 24, 2011 (JP) ..... 2011-065420

(51) Int. Cl.
*H01F 5/00* (2006.01)
*H01F 38/14* (2006.01)
(Continued)

(52) U.S. Cl.
CPC ..... *H01F 38/14* (2013.01); *H01F 1/15375* (2013.01); *H01F 41/02* (2013.01); *H01F 17/043* (2013.01); *H01F 27/2823* (2013.01); *H01F 41/0246* (2013.01); *Y10T 29/4902* (2015.01)

(58) Field of Classification Search
CPC ..... H01F 5/00; H01F 27/00–27/35
USPC ..... 336/65, 83, 200, 232–233
IPC ..... H01F 5/00, 27/28, 27/24
See application file for complete search history.

(56) References Cited

U.S. PATENT DOCUMENTS 8,184,454 B2 * 5/2012 Mao ..... 361/818
8,692,639 B2 * 4/2014 Baarman et al. ..... 336/200
(Continued)

FOREIGN PATENT DOCUMENTS

EP 1 801 739 A1 6/2007
EP 2 172 952 A1 4/2010
(Continued)

OTHER PUBLICATIONS

Feb. 3, 2014 Extended European Search Report issued in European Patent Application No. 12761335.4.
(Continued)

*Primary Examiner* — Tuyen Nguyen
(74) *Attorney, Agent, or Firm* — Oliff PLC

(57) ABSTRACT

The purpose of the present invention is to provide: a magnetic element for wireless power transmission, which is capable of feeding power with high power transmission efficiency, while increasing the heat dissipation performance; and a method for manufacturing the magnetic element for wireless power transmission magnetic element for wireless power transmission have configurations that respectively comprise planar coils through which an alternating current passes and magnetic parts which are arranged in parallel in the intervals between the copper wires of the planar coils when viewed in cross section. The magnetic parts comprise an epoxy resin in which iron-based amorphous particles FINEMET® serving as magnetic particles are dispersed, and the magnetic parts are integrated with the planar coils by being bonded to the planar coils in an electrically insulated state by means of the epoxy resin.

7 Claims, 12 Drawing Sheets

(51) Int. Cl.

| | |
|---|---|
| ***H01F 1/153*** | (2006.01) |
| *H01F 17/04* | (2006.01) |
| *H01F 27/28* | (2006.01) |
| *H01F 41/02* | (2006.01) |

(56) References Cited

U.S. PATENT DOCUMENTS

| | | | | |
|---|---|---|---|---|
| 2010/0050420 | A1 | 3/2010 | Kuo et al. | |
| 2010/0244582 | A1 | 9/2010 | Yoshikawa | |
| 2010/0253153 | A1 | 10/2010 | Kondo et al. | |
| 2010/0259353 | A1 | 10/2010 | Saito et al. | |
| 2011/0025133 | A1* | 2/2011 | Sauerlaender et al. | 307/104 |
| 2011/0050382 | A1 | 3/2011 | Baarman et al. | |
| 2013/0033348 | A1 | 2/2013 | Saito et al. | |

FOREIGN PATENT DOCUMENTS

| | | | |
|---|---|---|---|
| EP | 2 546 843 | A1 | 1/2013 |
| JP | A-60-34009 | | 2/1985 |
| JP | A-4-129206 | | 4/1992 |
| JP | A-2002-299138 | | 10/2002 |
| JP | A-2004-47700 | | 2/2004 |
| JP | 2005-116819 | A | 4/2005 |
| JP | A-2005-109173 | | 4/2005 |
| JP | A-2005-135948 | | 5/2005 |
| JP | A-2006-19418 | | 1/2006 |
| JP | A-2008-205264 | | 9/2008 |
| JP | 2009-094428 | A | 4/2009 |
| JP | 2010-186856 | A | 8/2010 |
| JP | A-2010-239848 | | 10/2010 |
| JP | A-2010-245323 | | 10/2010 |
| JP | A-2010-245473 | | 10/2010 |
| JP | 2010-272608 | A | 12/2010 |
| TW | 201011789 | A | 3/2010 |
| WO | WO 2011/001812 | A1 | 1/2011 |

OTHER PUBLICATIONS

Jun. 12, 2012 International Search Report issued in International Patent Application No. PCT/JP2012/055680 (with translation).

Oct. 3, 2013 International Preliminary Report on Patentability issued in International Application No. PCT/JP2012/055680.

Office Action issued in Japanese Patent Application No. 2011-065420 mailed on Aug. 12, 2014 (with translation).

Apr. 28, 2015 Office Action received in Japanese Application No. 2011-065420.

Apr. 24, 2015 Office Action issued in Taiwanese Application No. 101108291.

Jul. 2, 2015 Office Action issued in Chinese Application No. 201280015320.3.

* cited by examiner

MAGNETIC ELEMENT FOR WIRELESS POWER TRANSMISSION AND METHOD FOR MANUFACTURING SAME

TECHNICAL FIELD

The present invention relates to magnetic elements for wireless power transmission, which enables contactless power transmission.

BACKGROUND ART

There have been an increasing number of machines activated by cordless power supply utilizing electromagnetic inductance, such as electric toothbrushes, cordless telephones, and portable devices (e.g., PTL 1). There have also been developments of machines activated by cordless power supply utilizing magnetic resonance, in relation to wall-hang television sets and personal computers (e.g., PTL 2). To add this, there have been many developments and suggestions for magnetic elements for wireless power transmission capable of feeding high power with high power transmission efficiency, in the field of wireless power transmission.

However, feeding high power with high power transmission efficiency in such a magnetic element for wireless power transmission causes an excessive heat generation. This generated heat in the magnetic element for wireless power transmission may cause a problem to the magnetic element itself or to the functional parts of the element.

To address this problem of heat generation, for example, one approach is to adopt a structure of substrate having an in-built coil such as the one disclosed in PTL 3, in which a planar coil conductor to serve as the heat source is covered with a magnetic layer so as to radiate the heat outside through a conductor layer for heat transfer which is provided to the magnetic layer. This, without a doubt, enables radiation of heat generated by the planar coil to the outside.

CITATION LIST

Patent Literature

[PTL 1] Japanese Unexamined Patent Publication No. 47700/2004 (Tokukai 2004-47700)

[PTL 2] Japanese Unexamined Patent Publication No. 239848/2010 (Tokukai 2010-239848)

[PTL 3] Japanese Unexamined Patent Publication No. 205264/2008 (Tokukai 2008-205264)

SUMMARY OF INVENTION

Technical Problem

However, since the planar coil itself is covered by the magnetic layer, the magnetic field is shielded. This structure therefore is not suitable for use in a magnetic element for wireless power transmission, which utilizes electromagnetic inductance or magnetic resonance. Further, the structure necessitates an extra work in the manufacturing process, because the planar coil and the conductor layer for heat transfer need to be built in the magnetic layer.

In view of the above problems, an object of the present invention is to provide a magnetic element for wireless power transmission, which has improved heat dissipation performance and which is capable of feeding power with high power transmission efficiency, and to provide a method of manufacturing such an element.

Technical Solution

An aspect of the present invention to achieve the above object is a magnetic elements for wireless power transmission (hereinafter, simply referred to as magnetic element), which generates an induced electromotive force, including: a conductor portion through which an alternating current flows; and a magnetic part arranged in parallel to the conductor portion, wherein the magnetic part includes a resin in which magnetic particles are dispersed, and the conductor portion is at least partially bonded and integrated with the magnetic part, while being electrically insulated therefrom, by the resin.

In the above structure in which the conductor portion and the magnetic part are at least partially bonded and integrated with each other, the positional relation between the conductor portion and the magnetic part is maintained at the initial state, even when the conductor portion and the magnetic part are subject to an external force such as vibration or an impact. Thus, high power transmission efficiency at the initial stage is maintained for a long period of time. Further, when the conductor portion generates heat, the heat of the conductor portion is efficiently transferred to the magnetic part through the integrally bonded portions. It is therefore possible to efficiently radiate the heat of the conductor portion through the magnetic part. Thus, the amount of power conducted is increased as compared with a case where the conducting portion and the magnetic part are apart from each other. As the result, excessive heating of the conducting portion is prevented while improving the amount of power transmitted, with a simple structure in which the conducting portion and the magnetic part are at least partially integrated. The integration of the conducting portion with the magnetic part makes handling of the magnetic element easier. Therefore, the work for building the element into various devices and maintenance of the same becomes easy, and manufacturing of the magnetic element is simplified.

In the magnetic element of the above aspect of the present invention to achieve the object, the resin is a thermosetting resin.

In the structure, a bonded state of the conductive portion and the magnetic part is fixed simply by adding a thermal treatment for curing the thermosetting resin to the manufacturing process of the magnetic element, which easily realizes a simple manufacturing process.

In the magnetic element of the above aspect of the present invention to achieve the object, the resin is a thermoplastic resin.

With the structure, the bonded state of the conductor portion and the magnetic part is fixed by supplying the softened thermoplastic resin between the conductor portion and another conductor portion and solidifying the resin by cooling. As such, the manufacturing process of the magnetic elements for wireless power transmission is easily made easier simply by adding a thermal treatment for softening the thermoplastic resin to the manufacturing process.

In the magnetic element of the above aspect of the present invention to achieve the object, the magnetic particles are soft magnetism particles.

In the magnetic element of the above aspect of the present invention to achieve the object, the soft magnetism particles are metal based magnetic particles.

Since the metal based magnetic particles exhibit a high magnetic permeability, the above structure maintains a high magnetic shielding rate of the magnetic part.

In the magnetic element of the above aspect of the present invention to achieve the object, the metal based magnetic particles are amorphous particles.

These iron-based amorphous particles in the above structure have no crystal structure and have a high magnetic permeability. Therefore, it is possible to reduce the thickness of the magnetic part, while maintaining a high magnetic shielding rate.

In the magnetic element of the above aspect of the present invention to achieve the object, the magnetic part has a plurality of grooves.

With the structure in which a plurality of grooves are formed on the magnetic part, the surficial area of the magnetic part is increase. This improves the heat dissipation performance.

Another aspect of the present invention to achieve the above object is a method of manufacturing a magnetic element for wireless power transmission including: a magnetic particles dispersing process for dispersing magnetic particles in a resin; a B-staging process for heating the resin in which the magnetic particles are dispersed so as to cause the resin in a B-stage; a pressuring process for applying a pressure to a stack of conductor portions and the resin in the B-stage; and a curing process for curing the resin in the B-stage which is bonded with the conductor portions.

In the above method, the magnetic particles are dispersed in the resin. Therefore, the magnetic particles are easily evenly scattered in the resin. The magnetic element manufactured this way facilitates achievement of even thermal conductivity and magnetic property of the magnetic part.

Further, since the resin is brought into the B-stage by heating, the conductor portions and the resin in the B-stage are closely attached and bonded with each other by applying a pressure to a stack of the conductor portions and the resin in the B-stage stacked. In other words, the conductor portions and the resin in the B-stage are bonded and integrated with each other. By curing the resin in the B-stage which is bonded with the conductor portions, the resulting magnetic elements for wireless power transmission has conductor portions integrated with and fixed to a resin containing magnetic particles.

The method of the other aspect of the present invention to achieve the object is adapted so that, in the pressuring process, a plurality of grooves are formed to the resin in the B-stage.

The above method forming a plurality of grooves on the resin increases the surficial area of the resin in which the magnetic particles are dispersed. This improves the heat dissipation performance.

The method of the other aspect of the present invention to achieve the object is adapted so that, in the pressuring process, a conductive formed member having an interval between its conductor portions adjacent to each other is stacked with the resin in the B-stage, and is bonded by applying a pressure.

In the above method, when a pressure is applied to a stack of the resin in the B-stage and the conductive formed member having intervals between its conductor portions adjacent to each other, the resin in the B-stage enters the intervals, and is closely attached and bonded with the wall surface of the conductor portions facing the intervals.

The method of the other aspect of the present invention to achieve the object is adapted so that the resin is a thermosetting resin, and in the curing process, the thermosetting resin in the B-stage is cured by a thermal treatment.

With the above method, the connection state of the conductor portions and the resin is fixed simply by conducting a thermal treatment for curing the thermosetting resin.

The method of the other aspect of the present invention to achieve the object is adapted so that the resin is a thermoplastic resin, and in the curing process, the thermoplastic resin softened by a thermal treatment is supplied between the conductor portions and is fixed by solidifying the resin by cooling.

With the above method, the connection state between the conductor portions and the magnetic part is fixed simply by supplying the thermoplastic resin softened by the thermal treatment, between the conductor portions, and solidifying the resin by cooling. Therefore, it is easily possible to simplify the process of solidifying the resin.

Advantageous Effects

There is provided a magnetic element for wireless power transmission, which has a high heat dissipation performance and which is capable of feeding power with high power transmission efficiency, and a method of manufacturing such an element.

DESCRIPTION OF EMBODIMENTS

First, the following describes magnetic elements 1 and 2 for wireless power transmission related to the present invention, with reference to attached drawings.

(Overview of Magnetic Elements for Wireless Power Transmission)

Figure 1:
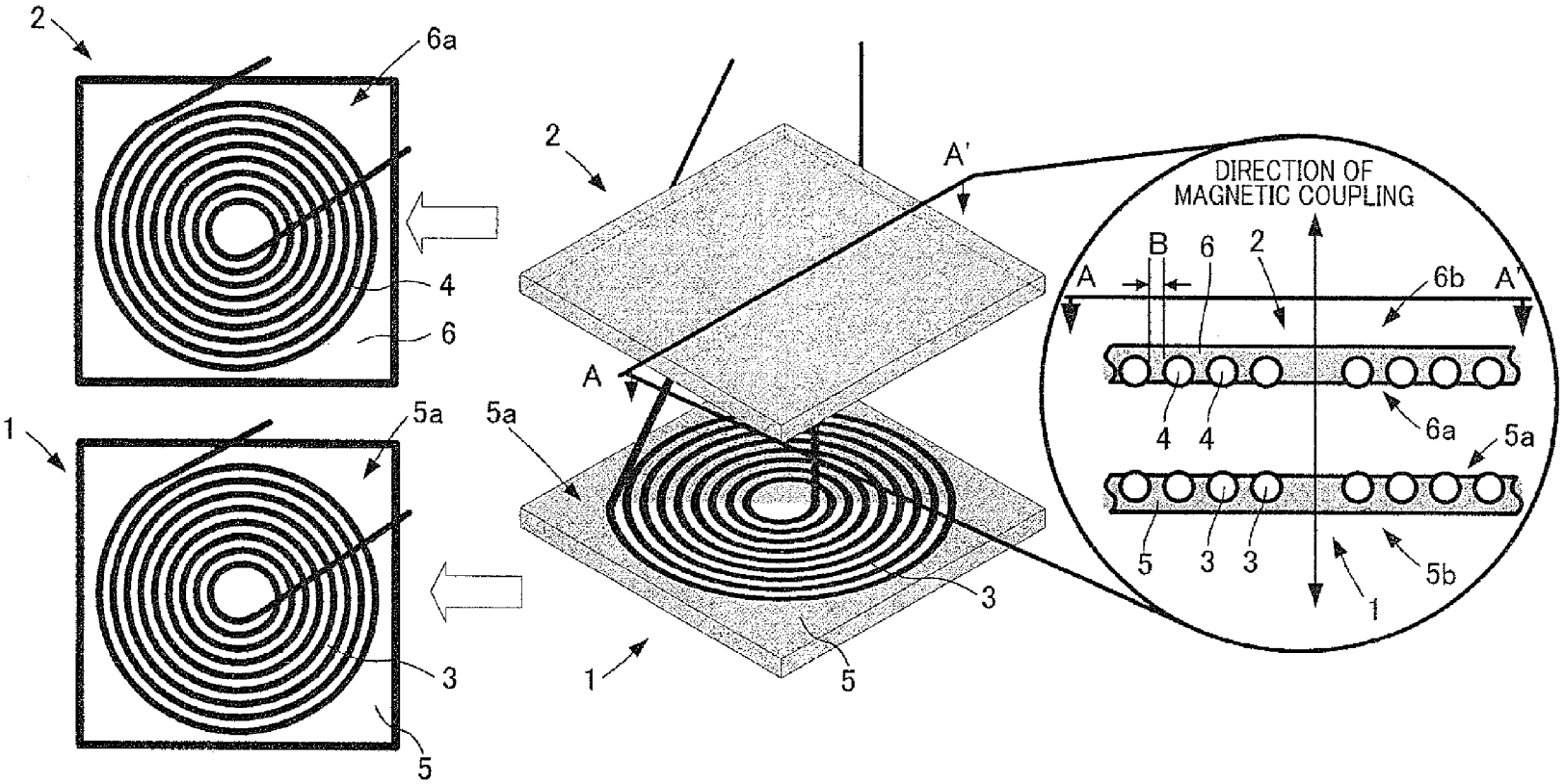
FIG. 1 is a diagram showing a structure of a magnetic element for wireless power transmission, related to Example.

As shown in FIG. 1, the magnetic elements 1 and 2 for wireless power transmission (hereinafter, simply referred to as magnetic elements 1 and 2) are structured to generate an induced electromotive force by magnetic coupling, and are each usable for both feeding power and receiving power. For feeding power, for example, the magnetic element 1 is applicable to a power supply device for feeding power to a device placed on somewhere while being used such as a personal computer and a mouse, which device is activated by cordless power feeding using electromagnetic inductance. Further, the magnetic element 1 is also applicable to a power supply device or the like for feeding power to an electric vehicle, and a wall-hanging type device such as a wall-hanging type flat panel television, which device is activated by cordless power feeding using magnetic resonance.

On the other hand, for receiving power, the magnetic element 2 is applicable to a device such as a personal computer and a mouse, which are placed or brought into contact with a power supply device, or to a wall-hanging type device such as a wall-hanging type flat panel television, or an electric vehicle.

As shown in FIG. 1, the magnetic element 1 for feeding power includes: a planar coil 3 (conductor portion) through which an alternating current flows; and a magnetic part 5 arranged in parallel to the planar coil 3 as shown in the cross sectional view taken along the line A-A' of FIG. 1. The magnetic part 5 has resin in which magnetic particles are dispersed, which is at least partially bonded and integrated with the conductor portion while being electrically insulated. Note that the magnetic element 2 for receiving power has the similar structure.

Examples of the conductor portion 3 in which the alternating current flows include a spiral type coil or a solenoid type coil. By the magnetic part 5 being arranged in parallel to the conductor portion 3, it means that the magnetic part 5 is arranged adjacent to the conductor portion 3, in a cross section taken in the a direction of magnetic coupling between the magnetic element 1 for feeding power and the magnetic element 2 for receiving power. The direction of magnetic coupling is a direction in which the center of a magnetically coupling side and the center of a magnetically coupled side, when the magnetically coupling side (power feeding end) and the magnetically coupled side (power receiving end) are disposed to face each other and in a positional relation such that the magnetic coupling becomes the strongest, thus generating a maximum induced electromotive force, as in a case where the magnetic element 1 for feeding power and the magnetic element 2 for receiving power having the same size are disposed so their center portions face each other.

In the above structure in which the planar coil 3 and the magnetic part 5 are at least partially bonded and integrated with each other, the positional relation between the planar coil 3 and the magnetic part 5 is maintained at the initial state, even when the planar coil 3 and the magnetic part 5 are subject to an external force such as vibration or an impact. Thus, high power transmission efficiency at the initial stage is maintained for a long period of time. Further, when the planar coil 3 generates heat, the heat of the planar coil 3 is efficiently transferred to the magnetic part 5 through the integrally bonded portions. It is therefore possible to efficiently radiate the heat of the conductor portion through the magnetic part 5. Thus, the amount of power conducted is increased as compared with a case where the planar coil 3 and the magnetic part 5 are apart from each other. As the result, excessive heating of the planar coil 3 is prevented while improving the amount of power transmitted, with a simple structure in which the planar coil 3 and the magnetic part 5 are at least partially integrated. The integration of the planar coil 3 with the magnetic part 5 makes handling of the magnetic element 1 easier. Therefore, the work for mounting the element 1 into various devices and maintenance of the same becomes easy, and manufacturing of the magnetic element 1 is simplified.

Next, the following details how the magnetic element 1 and 2 related to Example conducts power feeding from the magnetic element 1 to the magnetic element 2, using electromagnetic inductance.

(Structure of Magnetic Element 1)

Figure 2:
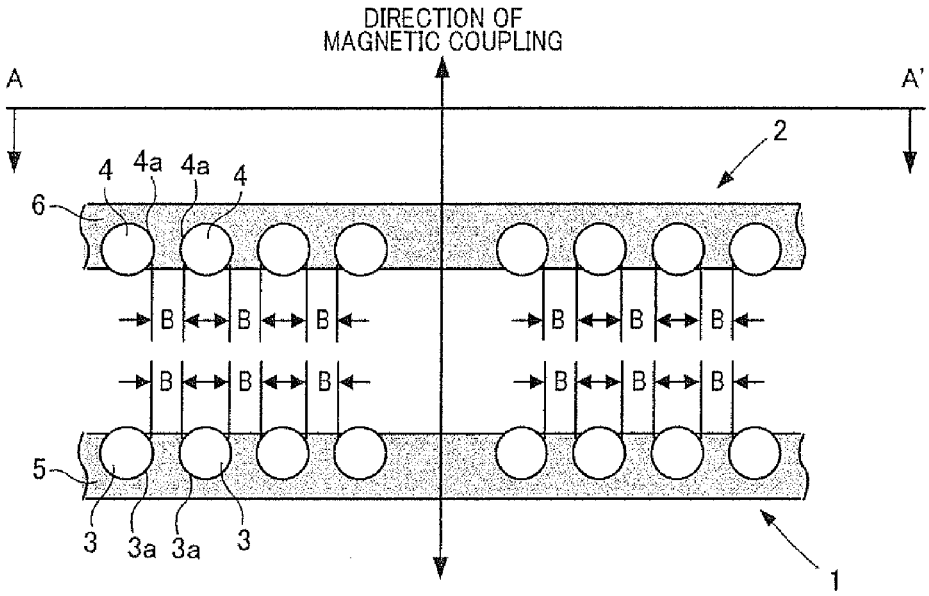
FIG. 2 is a cross sectional view of a magnetic element for wireless power transmission, which is taken along the line A-A'.

As shown in FIG. 1, in the magnetic element 1 for feeding power, the planar coil 3 (conductor portion) through which an alternating current flows and the magnetic part 5 adjacent to the planar coil 3 in a cross sectional view taken in a magnetic coupling direction, i.e., cross sectional view taken along the line A-A' of FIG. 1 and FIG. 2, are arranged in parallel to each other in a direction perpendicular to the magnetic coupling direction. The magnetic part 5 is structured by a resin in which magnetic particles are dispersed, and at least a part of the resin is bonded and integrated with the planar coil 3 while being electrically insulated. Note that the magnetic element 2 for receiving power has the similar structure, and the explanation is omitted. Note that the "direction perpendicular to" encompasses a "direction substantially perpendicular to".

(Planar Coil 3)

The planar coil 3 is formed by winding a round type copper wire material (with an insulation film) of 500 μmϕ in wire diameter 19 times in a spiral shape, at intervals B of 500 μm between windings of the copper wire, so as to form a planar coil having a coil inner-diameter of 5 mmϕ and a coil outer-diameter of 43 mmϕ. The material for the planar coil 3 is not limited as long as it is a metal material such as Cu, or Al. Further, the above mentioned structure of the planar coil 3 is no more than an example, and the shape and the size of the copper wire material, the size of each interval, and the number of windings are modifiable as needed.

Further, in the magnetic element 1 at the power feeding end, the planar coil 3 has one end portion on the outer circumference side and another end portion on the inner circumference side which are connected to a not-shown pair of terminals, respectively. The pair of terminals is connected to a power source device, so as to enable supplying of an alternating power of any frequency to the planar coil 3. Similarly, the planar coil 4 in the magnetic element 2 at the power receiving end also has one end portion on the outer circumference side and another end portion on the inner circumference side which are connected to a not-shown pair of terminals, respectively. Then, the pair of terminals are directly connected to a drive device or connected to a rectifier. In cases where the terminals are connected to the rectifier, that rectifier smoothens the alternating power generated by the electromagnetic inductance for use in charging a battery or activating a drive device.

(Magnetic Part 5)

The magnetic part 5 is made in the form of a square sheet with each side being 50 mm, and the thickness being 600 μm. As shown in FIG. 2, the magnetic part 5 is bonded with and closely attached to a wall surface 3*a* of the planar coil 3 so as to fill the intervals B of 500 μm of the planar coil 3. This way, in the vertical cross section (A-A' cross sectional view) matching with the magnetic coupling direction, the planar coil 3 and the magnetic part 5 are arranged in parallel to each other in a direction perpendicular to the magnetic coupling direction. Further, on the wall surface 3*a* of the planar coil 3, the magnetic part 5 is bonded and integrated with the planar coil 3, while being electrically insulated. Note that the above mentioned structure of the magnetic part 5 is no more than an example, and the shape, the size, the size of the intervals, and the like are modifiable as needed.

Further, as shown in FIG. 1, the magnetic element 1 has a surface 5*a* which serves as a magnetism open surface which faces the device on the power receiving end or the power feeding end, and a back surface 5*b*. A part of the planar coil 3 is exposed on the surface 5*a* of the sheet-form magnetic part 5.

(Magnetic Part 5: Resin)

The magnetic part 5 is structured by a resin in which magnetic particles are dispersed. This Example deals with a case of adopting an epoxy resin 10 as the resin which is a thermosetting resin. However, the resin is not particularly limited and is suitably adoptable as long as the resin is not the one that is not deteriorated even if the resin after being cured is left under a high temperature and/or a high humidity.

Examples of the epoxy resin includes: a glycidyl amine type epoxy resin, a bisphenol A type epoxy resin, a bisphenol F type epoxy resin, a phenol novolac type epoxy resin, a cresol novolac type epoxy resin, a biphenyl type epoxy resin, a naphthalin type epoxy resin, a aliphatic epoxy resin, a halogenated epoxy resin. These resins may be used singly or in combinations.

Note that, as the thermosetting resin, the following resins are also adoptable singly or in combination instead of the epoxy resin; a phenol resin, a melamine resin, a vinylester resin, a cyano ester resin, a maleimide resin, a thermosetting acrylic resin.

Further, a phenol resin is added to the epoxy resin 10 as an epoxy curing agent. The phenol resin serves as a curing agent for the epoxy resin, and examples thereof includes phenol novolac, naphthol novolac, biphenyl novolac, and the like. These substances may be adopted singly or in combination. A blending ratio of the above epoxy resin 10 and the phenol resin is preferably such that 0.5 to 2.0 eq. of hydroxy group in the phenol resin is blended with 1 eq. of epoxy group in the epoxy resin. More preferably, 0.8 to 1.2 eq.

Further, for example, an elastic body or a curing accelerator may be added to the resin structuring the magnetic part 5.

Examples of the elastic body includes: a rubber component traditionally used in an epoxy resin based adhesive agent such as acrylonitrile-butadiene rubber (NBR) and acrylic rubber, an acrylic resin, a phenoxy resin, a polyamide resin and the like. These materials may be used singly or in combination. In terms of flexibility of the sheet, it is preferable to adopt the NBR or the acrylic rubber. Further, it is particularly preferable that at least 5 wt. %, more preferably 5 to 30 wt. %, and even more preferably 5 to 20 wt. % of any of these materials adopted is copolymerized.

The curing accelerator used along with the epoxy resin 10 and the phenol resin is, for example, an amine type curing accelerator, or a phosphorus type curing accelerator. Examples of the amine type curing accelerator include imidazole derivatives such as 2-imidazole, and triethanol amine, and the like. Further, examples of the phosphorus type curing accelerator include triphenylphosphine and tetraphenylphosphonium. These materials may be used singly or in combination. The amount of the curing accelerator blended is preferably set to 0.1 to 2 wt. % of the entire epoxy resin composition. Further, in terms of fluidity of the epoxy resin composition, the amount to be blended is particularly preferably 0.15 to 0.35 wt. %.

Additionally to the epoxy resin, the epoxy curing agent, the elastic body, and the curing accelerator, it is possible to add a traditionally known additive such as pigment, a silane coupling agent, a dispersant, a defoamer, a flame retardant, an ion trapping agent, and the like to the extent that the properties of the magnetic part 5 are not deteriorated.

(Magnetic Part 5: Magnetic Particles)

The resin of the magnetic part 5 has therein magnetic particles dispersed. As the magnetic particles, soft magnetism particles are used. However, of the soft magnetism particles, it is preferable to adopt metal based magnetic particles. To add this, amorphous particles, among the metal based magnetic particles, are preferable. Note that the present embodiment deals with a case where the spherical FINEMET® (produced by Hitachi Metals, Ltd.) which is iron-based amorphous particles is used as the magnetic particles. These iron-based amorphous particles such as FINEMET® have no crystal structure and have a high magnetic permeability. Therefore, it is possible to reduce the thickness of the magnetic part 5, while maintaining a high magnetic shielding rate.

The soft magnetism particles are not particularly limited; however, examples of the soft magnetism particles include: permalloy based particles, silicon steel based particles, iron based magnetic particles and the like. Further, the iron based magnetic particles are not particularly limited, and any iron based magnetic particles may be suitably used, provided that a high magnetic permeability and a high thermal conductivity is achieved. An Fe—Al based alloy such as alperm, an Fe—Si based alloy such as silicon steel, an Fe—Al—Si based alloy such as sendust, ore a mixed particles of these may be adoptable. It is also possible to adopt particles of any one of an Fe—Ni based alloy, an Fe—Ni—Mo based alloy, an Fe—Ni—Mo—Cu based alloy, an Fe—Ni—Mo—Mn based alloy, or a mixed particles of any of these alloys each of which is a permalloy based alloy. Further, it is possible to adopt particles of any one of an Fe—Zr—B based alloy, a Fe—Zr—Nb—B based alloy, an Fe—Zr—Cu—B, an Fe—Si—B—Nb—Cu based alloy, an Fe—Co—Si—B—Nb—Cu based alloy, or a mixed particles of any of these alloys each of which is a non-crystalline material exhibiting a high magnetic permeability. Further, the amorphous particles may be particles of any one of an Fe—B—Si based alloy, an Fe—Co—Si—B based alloy, an Fe—B—Si—C based alloy, an Fe—Co—Ni—Si—B based alloy, or mixed particles of any of these alloys each of which is an amorphous alloy.

In cases where the magnetic particles are spherical particles, the mean grain diameter is 1 μm to 300 μm, preferably 20 μm to 50 μm. The amount of such spherical magnetic particles mixed into the resin is 50 Vol % to 90 Vol %. The reasons for the above ranges of mean grain diameters of the spherical particles are as follows. Namely, too small a mean grain diameter causes significant influence of a diamagnetic field, which deteriorates the magnetic permeability, and good absorption property becomes hard to obtain. On the other hand, too great a mean grain diameter of the spherical particles in the magnetic part 5 hinders reduction of the thickness, and deteriorates the smoothness of the surface of the magnetic part 5.

Further, in cases where the magnetic particles are flat particles, 20 to 70 vol %, preferably, 30 to 60 Vol % of flat magnetic particles with a grain diameter of not more than 50 μm, and with the aspect ratio of 10 or higher are added to the resin and mixed. The grain diameter smaller than 50 μm or the aspect ratio being less than 10 causes significant influence of a diamagnetic field, deteriorating the property of the magnetic field. Further, the amount of particles added to the resin being less than 20 vol % does not achieve an excellent magnetic property, and the amount of particles added being more than 70 vol % makes the sheet fragile.

(Operation)

Figure 3:
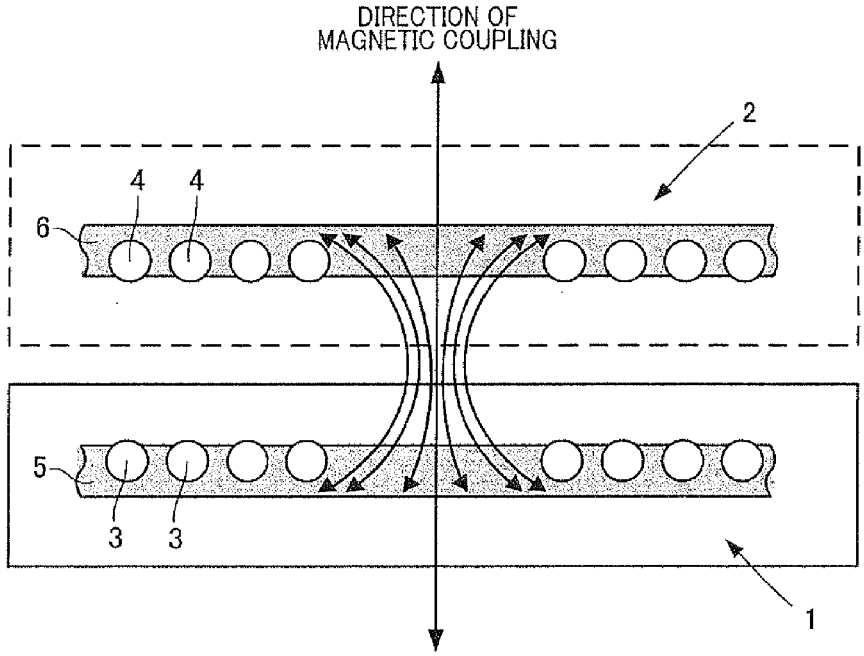
FIG. 3 is a first explanatory diagram showing the state of magnetic field of the magnetic element for wireless power transmission.
Figure 4:
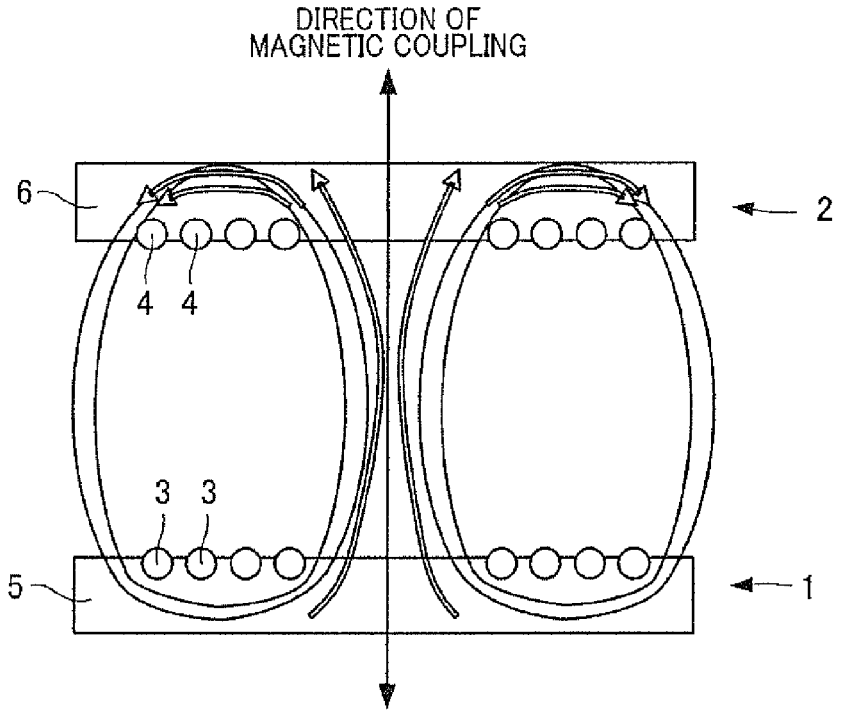
FIG. 4 is a second explanatory diagram showing the state of magnetic field of the magnetic element for wireless power transmission.

In the above structure, when a power source device is bonded to the magnetic element 1, and a high frequency alternating current (alternating power) is supplied, the magnetic element 1 generates an alternate magnetic field. As shown in FIG. 3, in the magnetic element 1, the planar coil 3 and the magnetic part 5 are arranged in parallel to each other relative to a direction perpendicular to the magnetic coupling direction, in a cross section taken in the magnetic coupling direction. This structure of the magnetic element 1, when compared with a structure of the same in which the magnetic part 5 is not arranged in parallel to the planar coil 3, reduces magnetic field around the planar coil 3 which is ineffective for magnetic coupling, and restrains spreading of the magnetic field shown overall, as shown in FIG. 4. As the result, the magnetic element 1 raises the magnetic flux density directed to the magnetic element 2 at the power receiving end. This enables feeding power from the magnetic element 1 to the magnetic element 2, with high power transmission efficiency.

Further, inside the magnetic element 1, the magnetic field generated by the alternating current flowing in the planar coil 3 generates an induced current by interplaying with another planar coil 3 arranged in parallel, and this induced current serves as a resistance. This phenomenon is restrained by the magnetic part 5 provided in the intervals B between windings of the planar coil 3. This reduces the resistance caused by the high magnetic flux density and the induced current, thus enabling feeding power and receiving power with high power transmission efficiency.

Further, when the planar coil 3 generates heat, the heat of the planar coil 3 is efficiently transferred to the magnetic part 5 through the wall surface 3*a* integrally bonded with the magnetic part 5. Therefore, the heat of the planar coil 3 is efficiently radiated through the magnetic part 5 between windings of the copper wire of the planar coil 3.

In the magnetic element 1 structured as described above has the magnetic part 5 integrally bonded with and firmly attached to the wall surface 3*a* of the planar coil 3 in such a manner as to fill up the intervals B between windings of the copper wire of the planar coil 3. This maintains the initial positional relation between the planar coil 3 and the magnetic part 5, even when the planar coil 3 and the magnetic part 5 are subject to an external force such as vibration and an impact. Therefore, the high power transmission efficiency at the initial state is maintained for a long period of time. Further, when the planar coil 3 generates heat, the heat of the planar coil 3 is efficiently transferred to the magnetic part 5 through the wall surface 3*a* of the planar coil 3 which is integrally bonded with the magnetic part 5. Therefore, the heat of the planar coil 3 is efficiently radiated through the magnetic part 5. This enables an increased amount of power conducted, as compared with a case where the planar coil 3 and the magnetic part 5 are apart from each other. As the result, the amount of transmission is increased while excessive heating of the planar coil 3 is prevented, with a structure in which the planar coil 3 and the magnetic part 5 are simply integrate with each other at the wall surface 3*a* of the planar coil 3. Further, integration of the planar coil 3 with the magnetic part 5 makes handling easier. Therefore, the work of embedding the magnetic element 1 into various devices and work for storing the same are made easier. Further, the magnetic part 5 whose structure includes the resin is flexible to the external force. As such, combining the planar coil 3 with the magnetic part 5 requires relatively small external force, which makes the manufacturing process of the magnetic element 1 easy.

Further, since a thermosetting resin is used for the magnetic part 5, a bonded state of the planar coil 3 and the magnetic part 5 is fixed simply by adding a heating process for curing the thermosetting resin to the manufacturing process of the magnetic element 1, which easily realizes a simple manufacturing process.

(Manufacturing Method of Magnetic Element 1)

Next, the following describes a manufacturing method of the magnetic element 1. Note that a manufacturing method of the magnetic element 2 is the same as the above manufacturing method.

In a container 20 containing methyl ethyl ketone (MEK), an epoxy resin, an acrylic rubber, a phenol resin, a curing accelerator, a dispersant, a silane coupling agent are dissolved (liquefied) at a compounding ratio of 55 wt. part, 10 wt. part, 35 wt. part, 1 wt. part, 1 wt. part, and 1 wt. part, respectively. Note that the following description assumes that the epoxy resin 10 contains all of these materials dissolved in the container 20. The present embodiment adopts, as the organic solvent, methyl ethyl ketone which is a ketone based solvent, for the sake of solubility.

Next, in the container 20 containing the liquefied epoxy resin 10, FINEMET®11 as the iron-based amorphous particles is added at a compounding ratio of 700 wt. part, and mixed by using a disperser, thereby dispersing the FINEMET® in the epoxy resin 10 (magnetic particles dispersing process).

Next, on one side of a plate of PET 24 with a silicon-treated surface, the liquefied epoxy resin 10 in which FINEMET®11 has been dispersed is applied to form a layer of approximately 300 μm in thickness, by using an applicator 25. The thickness of the liquefied epoxy resin 10 applied is not particularly limited; however, in terms of film formability, the thickness is usually set within a range of 30 to 500 um, preferably 50 to 300 um. Note that the PET 24 may also be a plastic base material such as polyester, polyamide, polyphenylene sulfide, polyimide, and polyethylene naphthalate; a porous base material; a paper base material such as glassine paper, fine quality paper, and Japanese paper; a non-woven fabric such as cellulose, polyamide, polyester, and aramid; and a metal film base material such as copper foil, aluminum foil, SUS foil, and a nickel foil.

Next, the epoxy resin 10 applied to the surface of the PET 24 is turned into the B-stage by using a thermal dryer to dry the resin for 12 minutes at 110° C. (B-staging process). As the result, the epoxy resin 10 in the B-stage, with a thickness of 250 μm is obtained on the surface of the PET 24. Note that the temperature and the period is adjusted according to the difference in the type of resins and the thickness of the resin applied in the B-staging process.

Figure 5:
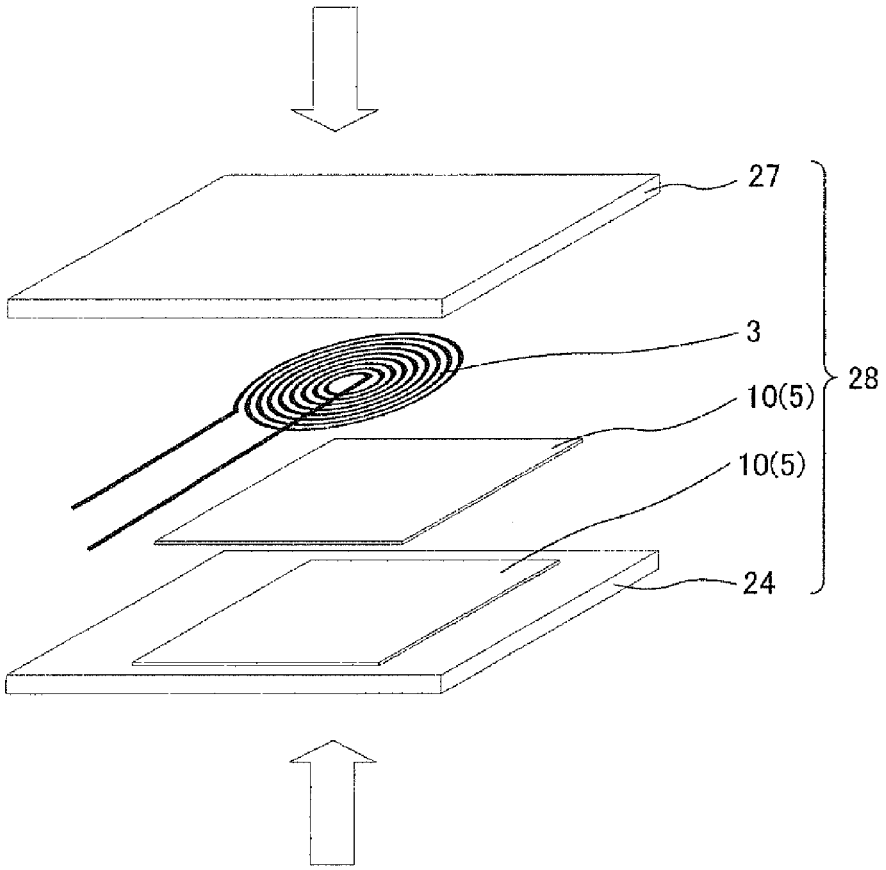
FIG. 5 is an explanatory diagram for explaining a method of manufacturing the magnetic element for wireless power transmission.

Next, a plurality of epoxy resin 10 layers, in the B-stage are laminated to achieve a desirable thickness. In the present embodiment, two layers of epoxy resin 10 in the B-stage are laminated to achieve a thickness of 500 μm. Specifically, as shown in FIG. 5, another layer of epoxy resin 10 in the B-stage is placed on the epoxy resin 10 in the B-stage on the surface of the PET 24. Then, the planar coil 3 is placed on a stack of epoxy resin 10 in the B-stage. Further, on the planar coil 3 is overlapped a plate of silicon-treated PET 27. Note that the planar coil 3 (conductive formed member) is formed by winding a round type copper wire material (with an insulation film) of 500 μmϕ in wire diameter 19 times in a spiral shape, at intervals B of 500 μm between windings of the copper wire, so as to form a planar coil having a coil inner-diameter of 5 mmϕ and a coil outer-diameter of 43 mmϕ, as hereinabove mentioned.

Then, a plate 28 having from the bottom a layer of the PET 24, the laminated layers of B-stage epoxy resin 10, planar coil 3, and another layer of PET 27 is pressurized from the top and bottom (pressuring process). In this pressuring process, the pressure vacuum laminator (V-130 produced by Nichigo-Morton Co., Ltd) is used for vacuum drawing for 10 seconds at 3 hPa. Then, the plate 28 is pressured for a pressuring period of 90 seconds at a temperature of 110° C., and a pressure of 0.1 MPa. Note that in the pressuring process too, the pressuring force, pressuring period, and the pressuring temperature are adjusted according to the type of resins used and the differences in the thicknesses of the resin layers.

Lastly, the magnetic element 1 taken out is subjected to a post curing process (after curing process) at 150° C., for approximately one hour, so as to thermally cure the epoxy resin 10 in the B-stage (curing process). Note that, the temperature and the period are adjusted according to the type of resins used, and the differences in the thicknesses of the resin layers. This magnetic element 1 has a flat plate shape, with the planar coils 3 are partially exposed and buried in the sheet of magnetic part 5, as shown in FIG. 1, and has the surface 5*a* and the back surface 5*b* to serve as the magnetism open surface facing the device on the power receiving end or the power feeding end.

With the manufacturing method, the FINEMET®11 which is the iron-based amorphous particles serving as the magnetic particles are dissolved in the dissolved epoxy resin 10. It is therefore easy to evenly disperse the FINEMET®11 in the epoxy resin 10. The magnetic element 1 manufactured this way facilitates achievement of even thermal conductivity and magnetism of the magnetic part 5.

Further, since the epoxy resin 10 is brought into the B-stage, the planar coil 3 and the epoxy resin 10 in the B-stage, when stacked and pressured, are easily brought into firmly attached and bonded state. That is, when the planar coil 3 having the intervals B between the adjacent windings of the copper wire and the epoxy resin 10 in the B-stage are stacked to each other and pressure, the epoxy resin 10 in the B-stage gets into the intervals B, and the epoxy resin 10 in the B-stage is closely attached and bonded with the wall surface 3*a* of the planar coil 3 which faces the intervals B, thus enabling integration of the epoxy resin 10 with the planar coil 3.

Further, the epoxy resin 10 which is a thermosetting resin is adopted for the resin, and the epoxy resin 10 in the B-stage in the curing process is subjected to the post curing process (thermal treatment) so as to bring the resin into cured state (C-stage). Subjecting the epoxy resin 10 in the B-stage to the post curing process (thermal treatment) cures the epoxy resin 10 in the B-stage between the intervals B of the windings of the copper wire of the planar coil 3, thus fixing the bonded state of the planar coil 3 and the epoxy resin 10. Then, with the epoxy resin 10 in the B-stage being cured while being bonded with the planar coil 3, the magnetic element 1 manufactured has the planar coil 3 integrated with and fixed to the epoxy resin 10 containing the FINEMET®11.

(Measurement of Power Transmission Efficiency and Heat Dissipation Performance)

The structure and a manufacturing method of the magnetic element 1 are described hereinabove. The following describes a comparative experiment for the insertion loss (S21) in an S parameter and the power transmission efficiency of the magnetic element 1, and a comparative experiment for the heat dissipation performance.

(Comparison of the Insertion Loss (S21) in S Parameter and Power Transmission Efficiency)

First, in Example 1, the insertion loss (S21) in the S parameter and the power transmission efficiency of magnetic elements 1 and 2 each having the above magnetic part 5 are measured. In Comparative Example 1, the insertion loss (S21) in the S parameter and the power transmission efficiency of a magnetic elements each having only the planar coil 3 but no magnetic part 5 are measured.

Example 1

Figure 6:
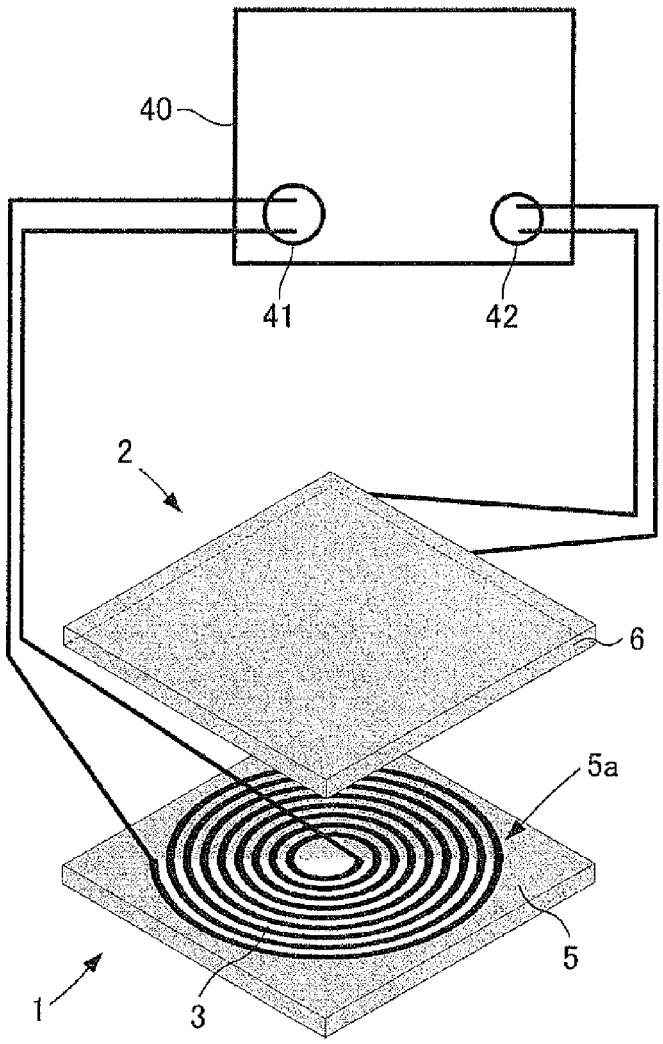
FIG. 6 is an explanatory diagram showing a structure for measuring an insertion loss (S21) of an S parameter and a power transmission efficiency of the magnetic element for wireless power transmission.

The above described magnetic elements 1 and 2 were used in Example 1. As shown in FIG. 6, the magnetic element 1 on the power feeding end and the magnetic element 2 on the power receiving end were disposed to face each other. At this time, the magnetic element 1 and the magnetic element 2 were spaced from each other by a distance of 3 mm. The elements were further disposed so that the shaft center of the planar coil 3 and that of the planar coil 4 coincided with each other. After this, a wire bonded with the one end portion on the outer circumference side and a wire bonded with the other end portion on the inner circumference side of the planar coil 3 were connected to terminals 41 of a network analyzer 40 (Agilent Technologies, Inc.) Further, a wire bonded with the one end portion on the outer circumference side and a wire bonded with the other end portion on the inner circumference side of the planar coil 4 were connected to a terminal 42 of the network analyzer 40 (Agilent Technologies, Inc.). Then, an insertion loss (S21) in the S parameter and the power transmission efficiency were measured at measurement frequencies of 300 kHz, 500 kHz, and 1000 kHz.

It should be noted that the power transmission efficiency is a ratio of power output from the magnetic element 2 on the power receiving end for the power supplied to the magnetic element on the power feeding end. In other words, the power transmission efficiency is an efficiency of transferring energy from the magnetic element 1 to the magnetic element 2. The insertion loss "S21" means, when signals is input to the terminal 41, the signals passing through the terminal 42. The insertion loss "S21" is expressed in decibel and the greater the value, the higher the power transmission efficiency. In other words, the higher the insertion loss "S21", the higher the power transmission efficiency.

Comparative Example 1

Next, the Comparative Example 1 involved a magnetic element for wireless power transmission (hereinafter, simply referred to as magnetic element), for feeding power which has only the planar coil 3 but no magnetic part 5, and a magnetic element for wireless power transmission (hereinafter, simply referred to as magnetic element), for receiving power which has only the planar coil 4 but no magnetic part 6. The magnetic elements were disposed so that the planar coil 3 on the power feeding end and that planar coil 4 on the power receiving end faced each other. The distance between the planar coil 3 and the planar coil 4 was 3 mm. The elements were disposed so that the shaft center of the planar coil 3 and that of the planar coil 4 coincided with each other. After that, a wire bonded with the one end portion on the outer circumference side and a wire bonded with the other end portion on the inner circumference side of the planar coil 3 were connected to the terminal 41 of the network analyzer 40 (Agilent Technologies, Inc.). Further, a wire bonded with the one end portion on the outer circumference side and a wire bonded with the other end portion on the inner circumference side of the planar coil 4 were connected to the terminal 42 of the network analyzer 40 (Agilent Technologies, Inc.). Then, the insertion loss (S21) in the S parameter and the power transmission efficiency were measured at measured frequencies of 300 kHz, 500 kHz, and 1000 kHz.

Measurement Result of Example 1 and Comparative Example 1

Figure 7A:
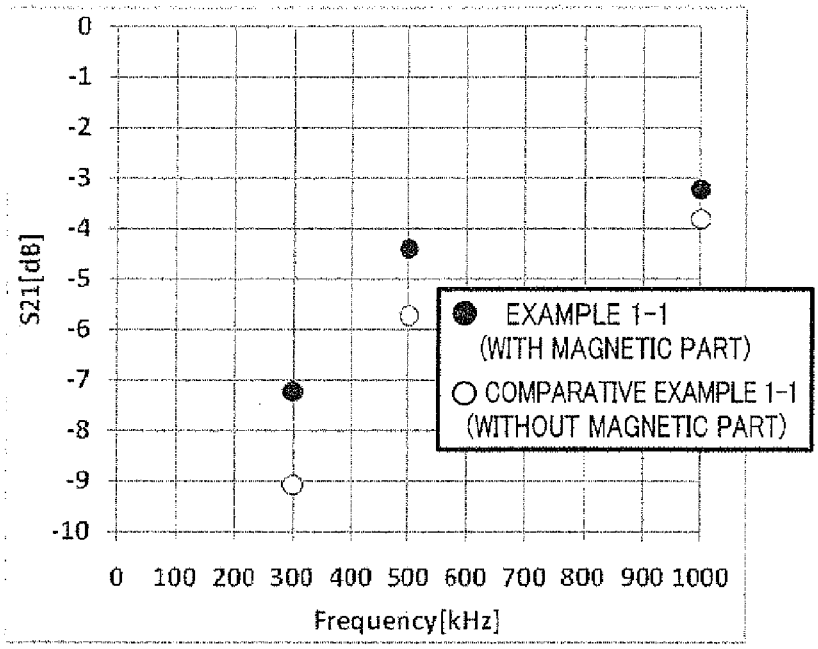
FIG. 7A is a graph showing an insertion loss (S21) of an S parameter of the magnetic element for wireless power transmission.
Figure 7B:
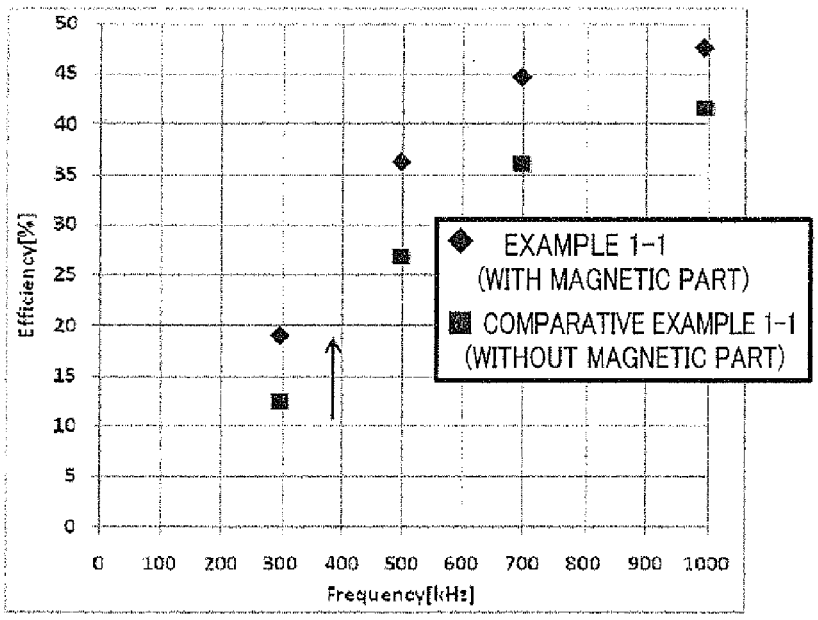
FIG. 7B is a graph showing a power transmission efficiency of the magnetic element for wireless power transmission.

The resulting insertion losses (S21) in the S parameter of the above measurements are shown in FIG. 7A. In FIG. 7A, the horizontal axis indicates the measured frequency and the vertical axis indicates the insertion loss "S21". Further, the resulting power transmission efficiency from the above measurements are shown in FIG. 7B. In FIG. 7B, the horizontal axis indicates the measured frequency, and the vertical axis indicates the power transmission efficiency (%).

From the above measurement results, it is found that Example 1 resulted in a higher insertion loss (S21) in the S parameter and a higher power transmission efficiency, than Comparative Example 1, Example 1 involving magnetic element 1 for feeding power and the magnetic element 2 for receiving power having the magnetic part 5 and the magnetic part 6, respectively, Comparative Example 1 involving the magnetic element for feeding power having only the planar coil 3 but no magnetic part 5 and a magnetic element for receiving power having only the planar coil 4 but no magnetic part 6. This shows that the power transmission efficiency, i.e., the efficiency of power transmission from the magnetic element 1 to the magnetic element 2 is improved by providing the magnetic part 5 and 6 to the magnetic element 1 and 2, respectively.

(Comparison of Heat Dissipation Performance)

Next, in Example 3, the temperature of the surface 5*a* of the magnetic element 1 having the magnetic part 5 was measured. Further, in Comparative Example 2, the surface temperature of a magnetic element having only the planar coil 3 and no magnetic part 5 was measured. Further, in Comparative Example 3, the surface temperature of a magnetic element having only a tightly-wound planar coil 59 and having no magnetic part was measured. Further, in Comparative Example 4, the surface temperature of a magnetic element 58 for wireless power transmission (hereinafter, simply referred to as magnetic element 58) having a tightly-wound planar coil 59 with a magnetic part 57 was measured.

Example 3

Figure 8:
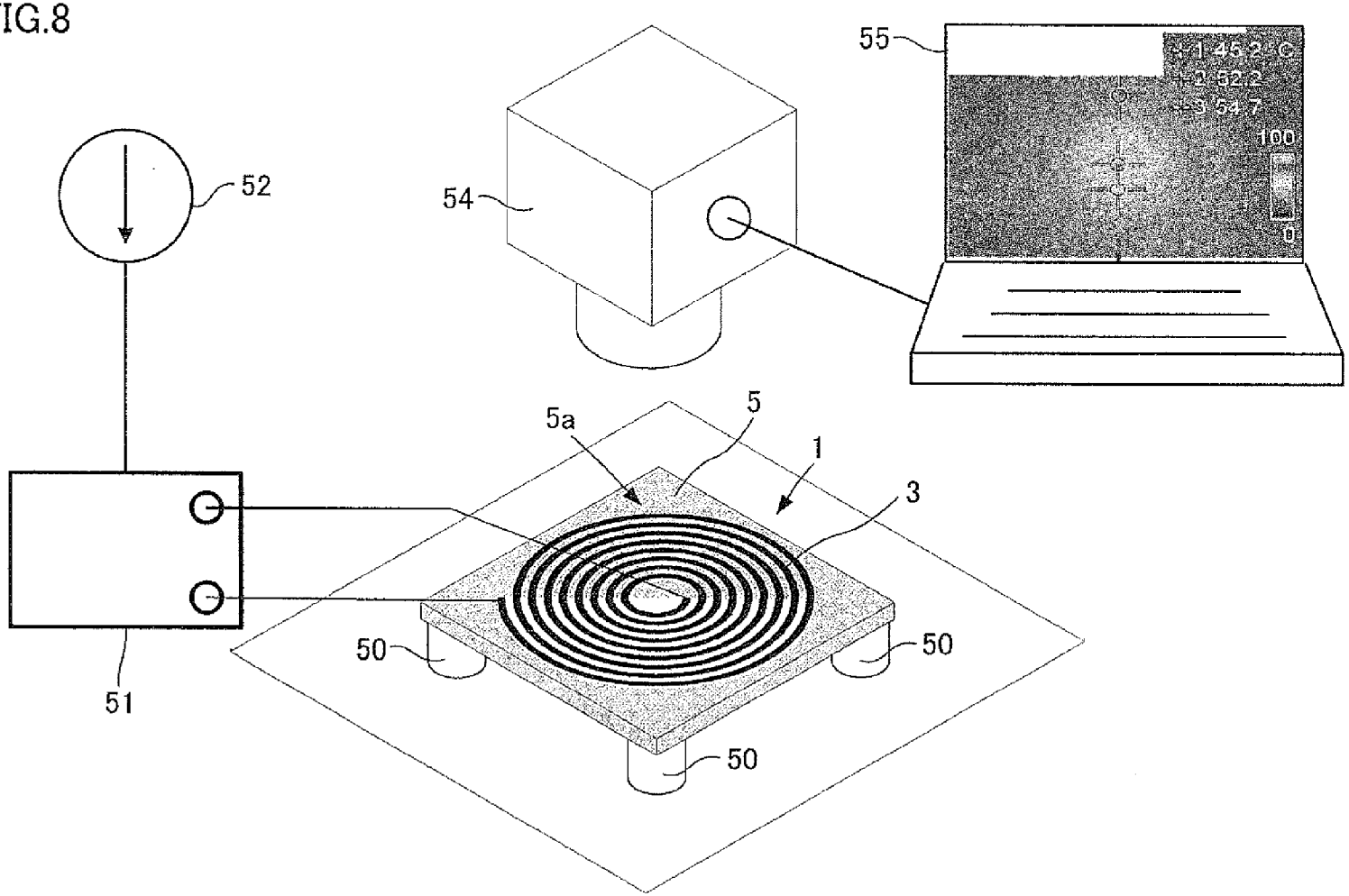
FIG. 8 is an explanatory diagram of a structure for measuring a surface temperature of the magnetic element for wireless power transmission.
Figure 9A:
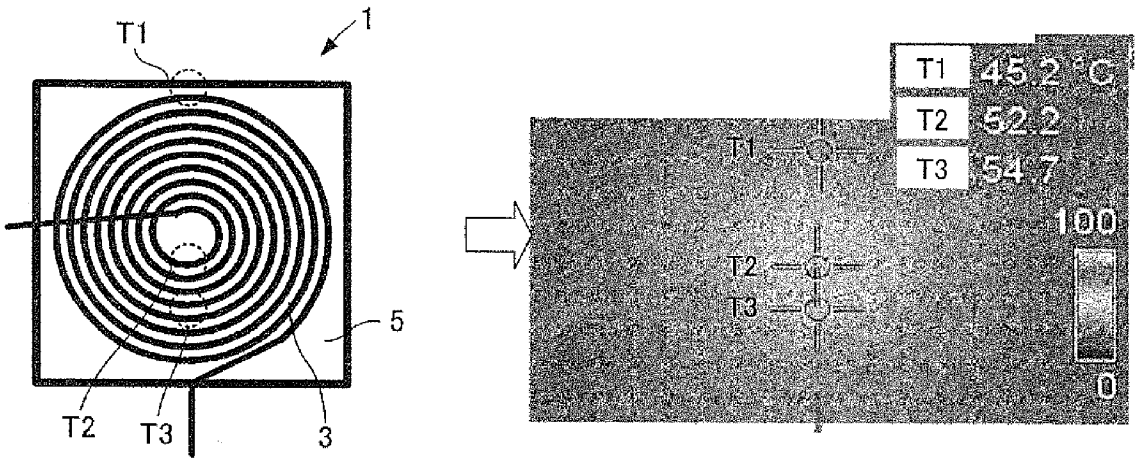
FIG. 9A is a diagram showing a measurement result of the surface temperature of a magnetic element for wireless power transmission related to Example 3.

Example 3 involves the above-described magnetic element 1. As shown in FIG. 8, the magnetic element 1 was disposed on four supports 50 so that the back surface 5*b* faces downwards. Then, a wire bonded with one end portion on the outer circumference side and another wire bonded with the other end portion on the inner circumference side of the planar coil 3 of the magnetic element 1 are connected to a direct current power source 52 via a power circuit 51. Then, an infrared thermography camera 54 was disposed above the magnetic element 1 so as to face its surface 5*a*. The infrared thermography camera 54 is connected to a personal computer 55, and enables observation of the surface temperature of the magnetic element 1 through its monitor. 2.5 W-power from the direct current power source 52 was converted to an alternate current of 200 kHz by the power circuit 51, and transmitted to the magnetic element 1. Then, the surface temperature of the magnetic element 1, five minutes after the beginning of the power transmission was monitored on a personal computer 55. The surface temperature of the magnetic element 1 was measured five minutes after the beginning of the power transmission, because the surface temperature of the magnetic element 1 stabilized five minutes after the beginning of the power transmission. In this measurement of the surface temperature of the magnetic element 1, the measurement was conducted in a portion T1 of the magnetic element 1 nearby the outer edge (hereinafter, outer edge portion T1), a portion T2 of the magnetic element 1 nearby the center portion (hereinafter, center portion T2), and a portion T3 between the outer edge and the center portion of the magnetic element 1 (hereinafter, midway portion T3), as shown in FIG. 9A.

Comparative Example 2

Figure 9B:
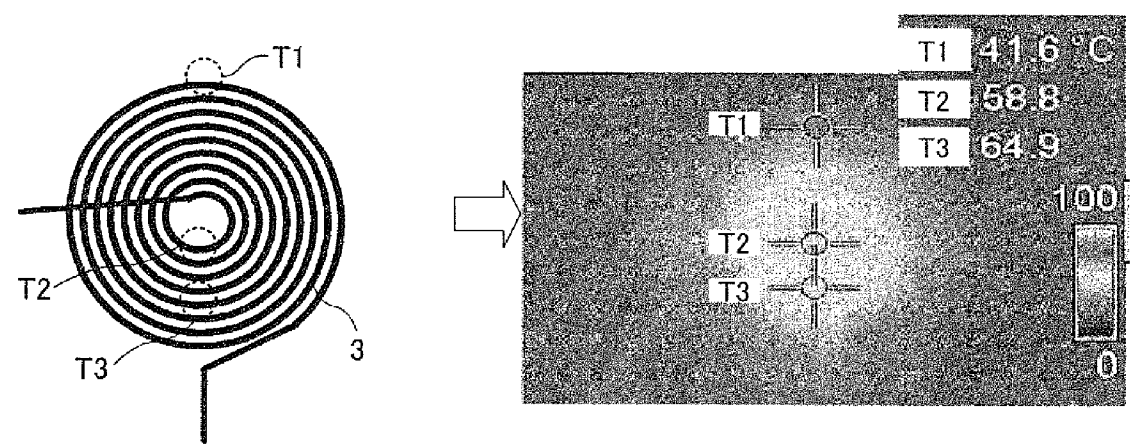
FIG. 9B is a diagram showing a measurement result of the surface temperature of a planar coil related to Comparative Example 2.

Comparative Example 2 involves a magnetic element for wireless power transmission (hereinafter, simply referred to as magnetic element), having a planar coil 3 but no magnetic part 5. As in Example 3, the planar coil 3 is disposed on four supports 50. Then, a wire bonded with one end portion on the outer circumference side and a wire bonded with the other end portion on the inner circumference side of the planar coil 3 are connected to a direct current power source 52 via the power circuit 51. The infrared thermography camera 54 was disposed above the planar coil 3 so as to face its surface. The infrared thermography camera 54 is connected to a personal computer 55, and enables observation of the surface temperature of the planar coil 3 through its monitor. 2.5 W-power from the direct current power source 52 was converted to an alternate current of 200 kHz by the power circuit 51, and transmitted to the planar coil 3. Then, the surface temperature of the planar coil 3, five minutes after the beginning of the power transmission was monitored on a personal computer 55. In this measurement of the surface temperature of the planar coil 3, the measurement was conducted in a portion T1 of the planar coil 3 nearby the outer edge (hereinafter, outer edge portion T1), a portion T2 of the planar coil 3 nearby the center portion (hereinafter, center portion T2), and a portion T3 between the outer edge and the center portion of the planar coil 3 (hereinafter, midway portion T3) as shown in FIG. 9B.

Comparative Example 3

Figure 10C:
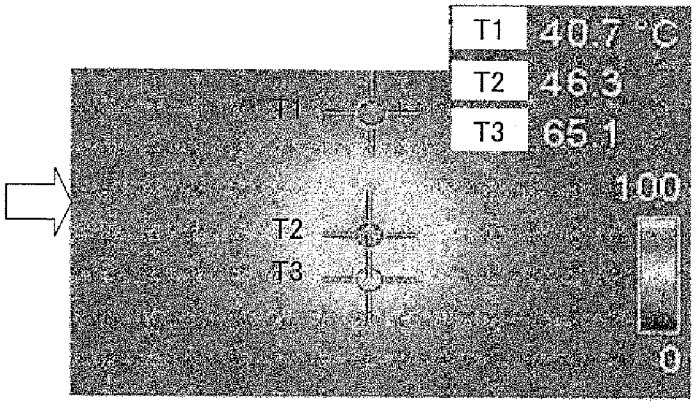
FIG. 10C is a diagram showing a measurement result of the surface temperature of a planar coil related to Comparative Example 3.

Comparative Example 3 involves a magnetic element for wireless power transmission (hereinafter, simply referred to as magnetic element), having a tightly-wound planar coil 59 but no magnetic part. Specifically, the tightly-wound planar coil 59 is formed by winding a round type copper wire material (with an insulation film) of 500 μmϕ in wire diameter 36 times in a spiral shape without intervals between windings of the copper wire, so as to form a planar coil having a coil inner-diameter of 5 mmϕ and a coil outer-diameter of 43 mmϕ. As in Example 3, the planar coil 59 is disposed on four supports 50. Then, a wire bonded with one end portion on the outer circumference side and a wire bonded with the other end portion on the inner circumference side of the planar coil 59 are connected to a direct current power source 52 via the power circuit 51. The infrared thermography camera 54 was disposed above the planar coil 59 so as to face its surface. The infrared thermography camera 54 is connected to a personal computer 55, and enables observation of the surface temperature of the planar coil 59 through its monitor. 2.5 W-power from the direct current power source 52 was converted to an alternate current of 200 kHz by the power circuit 51, and transmitted to the planar coil 59. Then, the surface temperature of the planar coil 59, five minutes after the beginning of the power transmission was monitored on a personal computer 55. In this measurement of the surface temperature of the planar coil 59, the measurement was conducted in a portion T1 of the planar coil 59 nearby the outer edge (hereinafter, outer edge portion T1), a portion T2 of the planar coil 59 nearby the center portion (hereinafter, center portion T2), and a portion T3 between the outer edge and the center portion of the planar coil 59 (hereinafter, midway portion T3), as shown in FIG. 10C.

Comparative Example 4

Comparative Example 4 involves a magnetic element 58 for wireless power transmission (hereinafter, simply referred to as magnetic element 58), having a tightly-wound planar coil 59 but no magnetic part 57. The magnetic part 57 is formed in the form of square sheet of 600 μm in thickness, with the length of each side being 50 mm. In the magnetic element 58, the planar coil 59 closely attached and bonded with to the magnetic part 57 is entirely buried in the magnetic part 57. In other words, the magnetic element 58 of Comparative Example 4, unlike Example 3, has no intervals between windings of the copper wire of the planar coil 59; the windings of copper wire of the planar coil 59 and the magnetic part 57 are not arranged in parallel and not alternated in a direction perpendicular to the magnetic coupling direction in a vertical cross section taken in the magnetic coupling direction.

Then, similarly to Example 3, the magnetic element 58 is disposed on four supports 50 so that the surface on which planar coil 59 can be seen is faced upward. Then, a wire bonded with one end portion on the outer circumference side and another wire bonded with the other end portion on the inner circumference side of the planar coil 59 of the magnetic element 58 are connected to a direct current power source 52 via a power circuit 51. Then, an infrared thermography camera 54 was disposed above the magnetic element 58 so as to face its surface. The infrared thermography camera 54 is connected to a personal computer 55, and enables observation of the surface temperature of the magnetic element 58 through its monitor. 2.5 W-power from the direct current power source 52 was converted to an alternate current of 200 kHz by the power circuit 51, and transmitted to the magnetic element 58. Then, the surface temperature of the magnetic element 58, five minutes after the beginning of the power transmission was monitored on a personal computer 55. In this measurement of the surface temperature of the magnetic element 58, the measurement was conducted in a portion T1 of the magnetic element 58 nearby the outer edge (hereinafter, outer edge portion T1), a portion T2 of the magnetic element 58 nearby the center portion (hereinafter, center portion T2), and a portion T3 between the outer edge and the center portion of the magnetic element 58 (hereinafter, midway portion T3), as shown in FIG. 10D.

Measurement Results of Example 3, Comparative Example 2, Comparative Example 3, Comparative Example 4

Figure 10D:
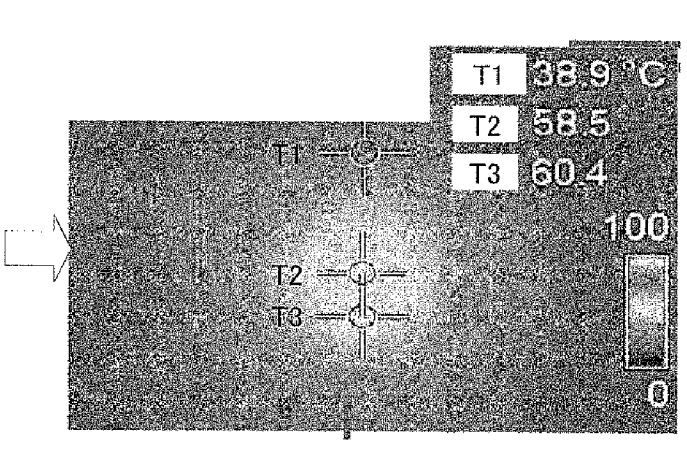
FIG. 10D is a diagram showing a measurement result of the surface temperature of a magnetic element for wireless power transmission related to Comparative Example 4.

The results of the above measurements are shown in FIG. 9 and FIG. 10, FIG. 9A shows the surface temperature of the magnetic element 1 related to Example 3. FIG. 9B shows the surface temperature of the planar coil 3 related to Comparative Example 2. FIG. 10C shows the surface temperature of the planar coil 59 related to Comparative Example 3. FIG. 10D shows the surface temperature of the magnetic element 58 related to Comparative Example 3.

In the above measurements, the resulting surface temperatures of the outer edge portion T1, the pcenter ortion T2, the midway portion T3 of the magnetic element 1 related to Example 3 were 45.2° C., 52.2° C., and 54.7° C., respectively. Further, the resulting surface temperatures of the outer edge portion T1, the pcenter ortion T2, and the midway portion T3 of the planar coil 3 related to Comparative Example 2 were 41.6° C., 58.8° C., and 64.9° C., respectively. Further, the resulting surface temperatures of the outer edge portion T1, the pcenter ortion. T2, and the midway portion T3 of planar coil 59 related to Comparative Example 3 were 40.7° C., 46.3° C., and 65.1° C., respectively. Further, the resulting surface temperatures of the outer edge portion T1, the pcenter ortion T2, and the midway portion T3 of the magnetic element 58 related to Comparative Example 4 were 38.9° C., 58.5° C., and 60.4° C., respectively.

When comparing the magnetic element 1 related to Example 3 having the magnetic part 5 with the magnetic element related to Comparative Example 2 having only the planar coil 3 and no magnetic part 5, it is understood that the resulting surface temperatures of the pcenter ortion T2 and the midway portion T3 were lower in the magnetic element 1 of Example 3 than they were in the magnetic element of Comparative Example 2. The measured temperature at the outer edge portion T1 is lower in Comparative Example 2; however, it is believed that the temperature of the atmosphere was measured at the outer edge portion T1 in Comparative Example 2, because the magnetic element of Comparative Example 2 does not have a magnetic part. Thus, it should be understood that the magnetic element 1 of Example 3 having the magnetic part 5 has a higher heat dissipation performance as compared with the magnetic element of Comparative Example 2 having only the planar coil 3 and no magnetic part 5.

Further, when comparing the magnetic element 58 of Comparative Example 4 having the magnetic part 57 with the magnetic element of Comparative Example 3 having only the planar coil 59 and no magnetic part 57, it is understood that the surface temperatures at the outer edge portion T1 and the midway portion T3 are lower in the magnetic element. Note that the measured temperature at the pcenter ortion T2 is lower in Comparative Example 4; however, it is believed that the temperature of the atmosphere was mainly measured at the pcenter ortion T2 in Comparative Example 3, because the magnetic element of Comparative Example 2 does not have a magnetic part. Thus, it should be understood that the magnetic element 58 of Comparative Example 4 having the magnetic part 57 has a higher heat dissipation performance as compared with the magnetic element of Comparative Example 3 having only the planar coil 59 and no magnetic part 57. In other words, with the magnetic part 57, it is possible to achieve a high heat dissipation performance, even in cases of a tightly-wound planar coil 59 having no intervals between windings of the copper wire forming the coil.

It should be further understood that the resulting surface temperatures in the outer edge portion T1 and the midway portion T3 are substantially the same in the tightly-wound planar coil 59 of Comparative Example 3 and the planar coil 3 of Comparative Example 2. Note that the surface temperatures in the portions T2 nearby the center portion of the planar coil 59 and the planar coil 3 are significantly different; however, it is believed that the surface temperature in the portion T2 of Comparative Example 3 resulted in a significantly low temperature (46.3° C.), because, in Comparative Example 3, the temperature of the atmosphere was measured at the center portion of the planar coil 59 in which portion there is not coil. Therefore, the surface temperature of the planar coil 3 related to Comparative Example 2 and the surface temperature of the tightly-wound planar coil 59 of Comparative Example 3 have substantially no difference.

Knowing that the surface temperature of the planar coil 3 of Comparative Example 2 and the surface temperature of the tightly-wound planar coil 59 of Comparative Example 3 have substantially no difference, the magnetic element 1 related to Example 3 which is the planar coil 3 of Comparative Example 2 provided with the magnetic part 5 and the magnetic element 58 of Comparative Example 4 which is the tightly-wound planar coil 59 of Comparative Example 3 provided with the magnetic part 57 are compared. That is, the difference between Example 3 and Comparative Example 4 is the presence or absence of intervals between windings of the copper wire of the planar coil. As the result, it is found that the surface temperatures of the pcenter ortion T2 and the midway portion T3 is lower in the magnetic element 1 related to Example 3 which adopts the planar coil 3 having intervals between windings of the copper wire forming the coil, as compared with the magnetic element 58 related to Comparative Example 4 which adopts the planar coil 59 having no intervals between windings of the copper wire forming the coil. Note that the measured temperature at the outer edge portion T1 is lower in Comparative Example 4; however, it is believed that, since the magnetic element 58 of Comparative Example 4 adopts the planar coil 59 having no intervals between windings of the copper wire forming the coil, the surficial area of the planar coil 59 contacting the magnetic part 57 is reduced, and for this reason, the thermal conductivity to the magnetic part 57 did not reach the sufficient level in five minutes after the beginning of power transmission. Therefore, the magnetic element 1 of Example 3 adopting the planar coil 3 having intervals between windings of the copper wire forming the coil exhibited a better heat dissipation performance, as compared with the magnetic element 58 of Comparative Example 4 adopting the planar coil 59 having no intervals between windings of the copper wire forming the coil. That is, in a magnetic element for wireless power transmission, having the magnetic part, the heat dissipation performance is improved with intervals between windings of the copper wire forming the planar coil.

Other Examples

Figure 11B:
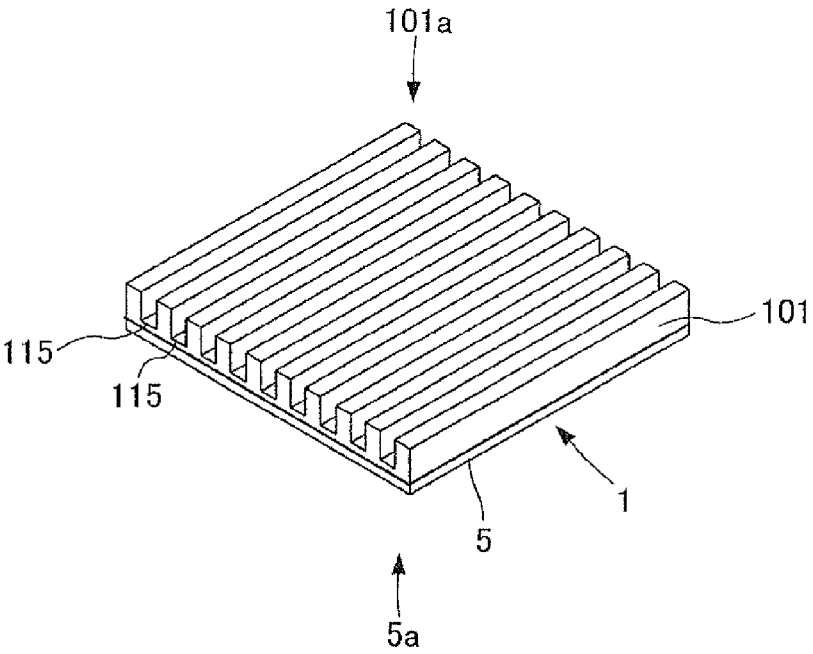
FIG. 11B is a perspective view showing a groove of the heat sink of the magnetic element for wireless power transmission, having the heat sink.
Figure 11A:
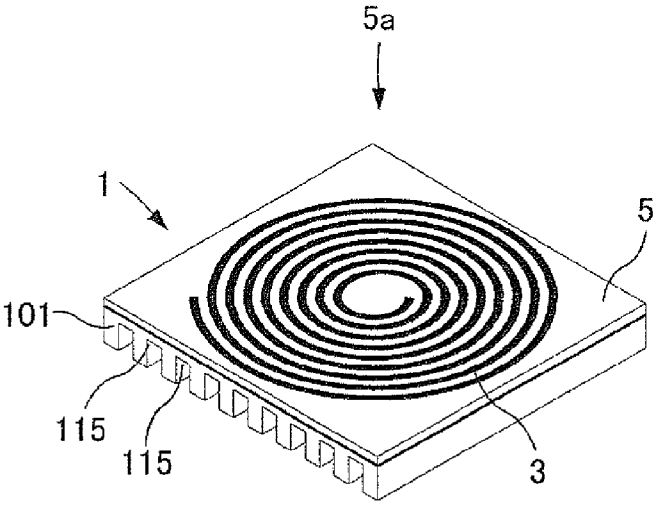
FIG. 11A is a perspective view showing a surface of a magnetic element for wireless power transmission, having a heat sink.

The magnetic elements 1 of the above Examples each is formed in a flat plate shape and has the magnetic part 5 in the form of sheet having the surface 5*a* on which a part of the planar coil 3 exposed and a planar back surface 5*b*. As shown in FIG. 11A,B, it is possible to provide a metal made heat sink 101 on the back surface 5*b* of the magnetic element 1. This heat sink 101 has a plane surface which contacts the back surface 5*b* of the magnetic element 1 however, its surface 101*a* on the opposite side to the contact surface has a plurality of grooves 115. Note that FIG. 11A is a perspective view showing the surface 5*a* of the magnetic element having the heat sink 101. FIG. 11B is a perspective view showing the grooves 115 of the heat sink 101 on the magnetic element 1.

With the plurality of grooves 115 on the heat sink 101, the surficial area is increased thereby improving the heat dissipation performance. With the provision of this heat sink 101 to the back surface 5*b* of the magnetic element 1, the heat is transferred from the back surface 5*b* of the magnetic element 1 to the heat sink 101, and efficiently dissipated through the grooves 115.

Figure 12B:
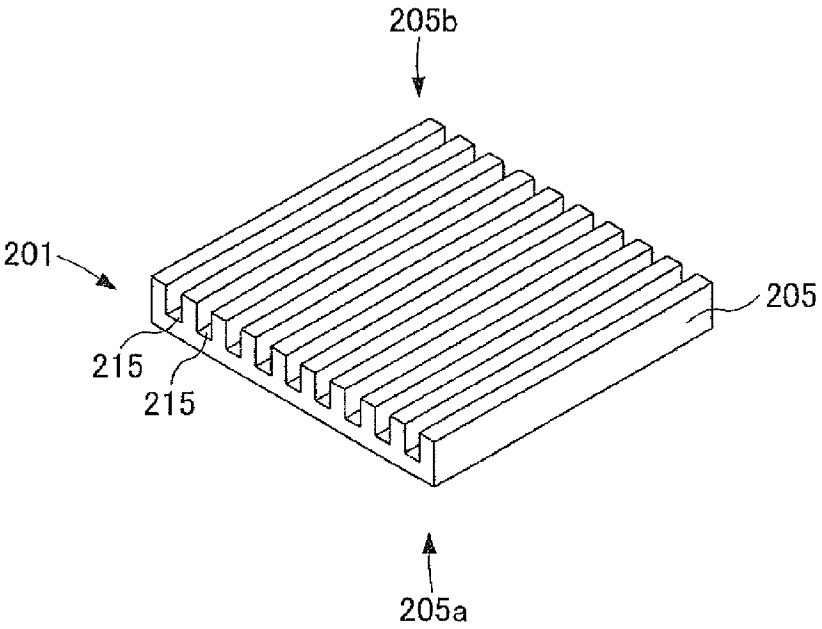
FIG. 12B is a perspective view showing the back surface of the magnetic element for wireless power transmission related to the other embodiment.
Figure 12A:
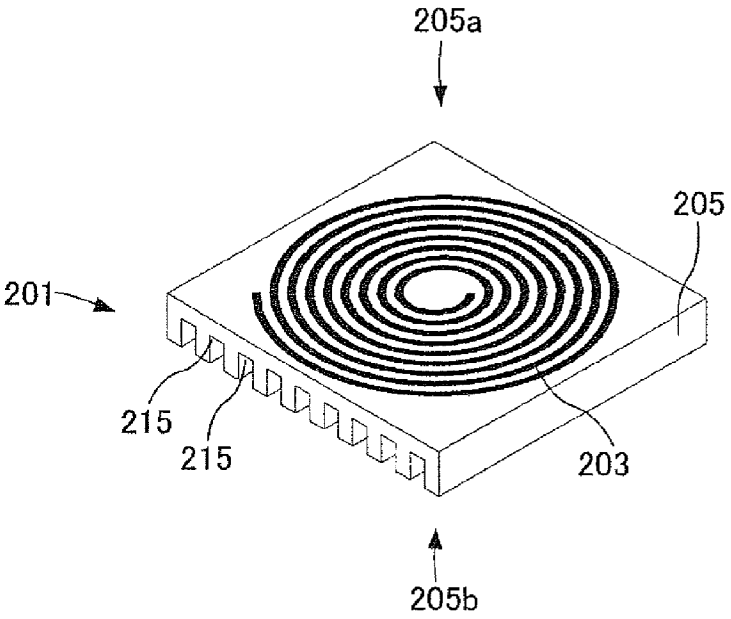
FIG. 12A is a perspective view showing a surface of a magnetic element for wireless power transmission related to another embodiment.

Alternatively, as shown in FIG. 12A,B, it is possible to form a plurality of grooves 215 on the back surface 205*b* of the magnetic part 205 of the magnetic element 201. Note that FIG. 12A is a perspective view showing the surface 205*a* of the magnetic element 201, FIG. 12B is a perspective view showing the back surface 205*b* of the magnetic element 201.

To form these grooves 215, a die having a groove forming unit for forming a plurality of grooves is placed on the back surface (the surface to become the back surface 205*b* of the magnetic part 205) of the epoxy resin in the B-stage, during the pressuring process. Then, a plate sequentially including, from the bottom, the die, the epoxy resin in the B-stage, and the planar coil is pressured from the top and bottom to form the grooves 215.

This way, the grooves 215 are formed on the back surface 205*b* of the magnetic part 205 of the magnetic element 201. Formation of these grooves 215 increases the surficial area of the magnetic part 205, which consequently achieves a higher heat dissipation performance.

Figure 13B:
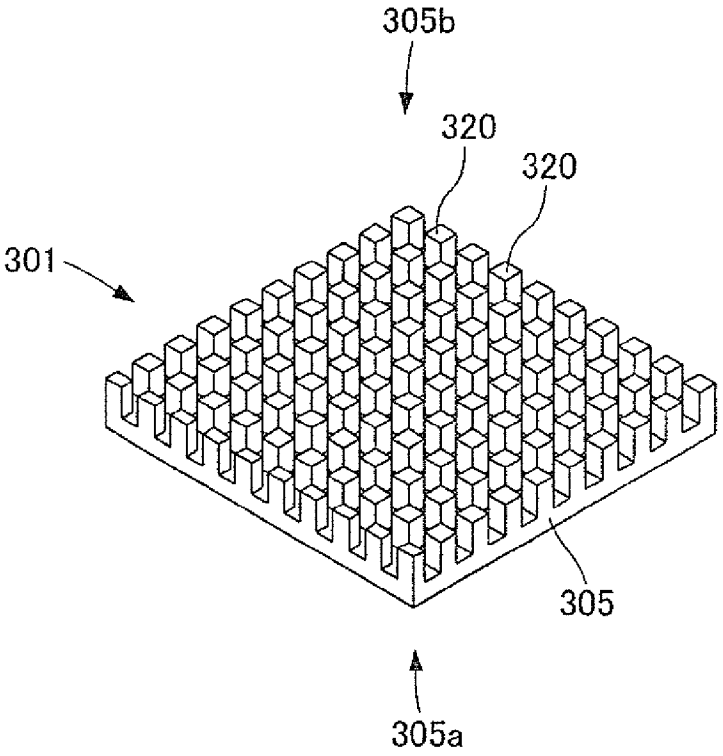
FIG. 13B is a perspective view showing the magnetic element for wireless power transmission related to the other embodiment.
Figure 13A:
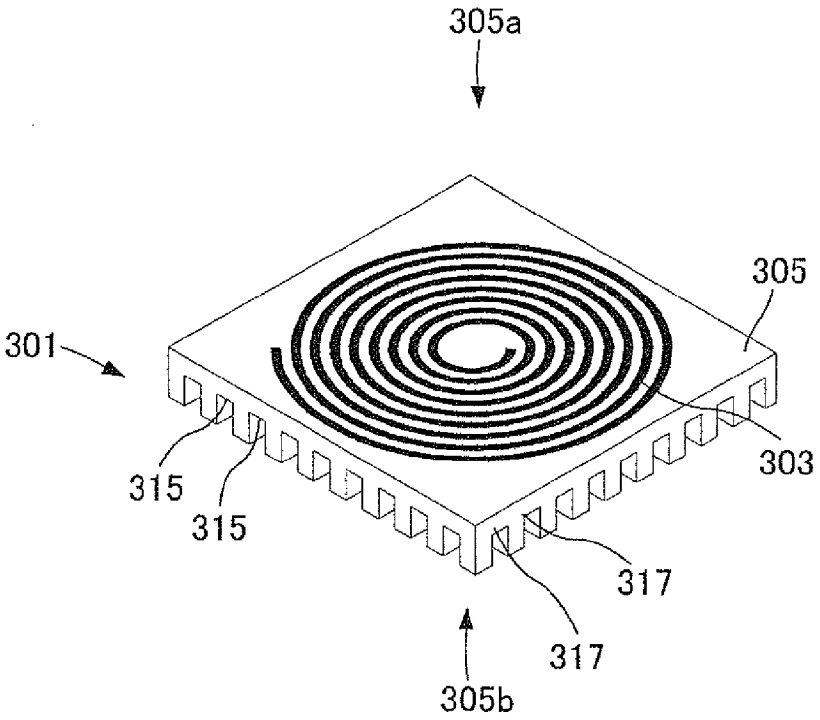
FIG. 13A is a perspective view of the magnetic element for wireless power transmission related to the other embodiment.

The structures of the grooves are not limited to the ones shown in FIG. 12. For example, it is possible to form a plurality of longitudinal grooves 315 and a plurality of transversal grooves 317 so as to form a plurality of projections 320 on the back surface 305*b* of the magnetic part 305 of the magnetic element 301, as shown in FIG. 13A, 13B.

Further, the magnetic part 5 is not limited to a thermosetting resin, and a thermoplastic resin may be also adoptable. A thermoplastic resin can be repetitively softened by heating and made solid by cooling. Specifically, a thermoplastic resin softens and can be formed into any intended shape by heating it up to its melting point. Therefore, a thermoplastic resin can be injected between windings of the copper wire of the planar coil 3. Examples of the thermoplastic resin includes: PP (polypropylene), ABS (Acrylonitrile butadiene styrene copolymer), PET (polyethylene terephthalate), PE (polyethylene), PC (polycarbonate).

In cases of adopting a thermoplastic resin for the magnetic part, the thermoplastic resin softened by a thermal treatment is fixed by supplying it to the intervals B between windings of the copper wire of the planar coil 3, and then solidifying the resin by cooling.

With the method, the connection state of the planar coil 3 and the thermoplastic resin serving as the magnetic part is fixed simply by supplying the thermoplastic resin softened by a thermal treatment in the intervals B between windings of the copper wire of the planar coil 3, and then solidifying the resin by cooling.

In the detailed description provided above, characteristic parts have mainly been described in order that the present invention can be understood more easily. However, the present invention is not limited to the embodiment shown in the detailed description provided above, and may be applied to other embodiments. The scope of application of the present invention should be construed as Broadly as possible. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. Accordingly, it should be considered that claims cover equivalent structures, too, without departing from the technical idea of the present invention. In addition, it is desirable to sufficiently refer to already-disclosed documents and the like, in order to fully understand the objects and effects of the present invention.

REFERENCE SIGNS LIST

1, 2 Magnetic Element for Wireless Power Transmission
3, 4 Planar Coil
3*a*, 4*a* Wall Surface
5, 6 Magnetic Part
B Interval

The invention claimed is:

1. A magnetic element for wireless power transmission, which generates an induced electromotive force, comprising:

a conductor portion through which an alternating current flows; and a magnetic part arranged in parallel to the conductor portion, wherein the magnetic part includes a resin in which magnetic particles are dispersed, and the conductor portion is at least partially bonded and integrated with the magnetic part, while being electrically insulated therefrom, by the resin, and wherein the magnetic particles are either spherical particles or flat particles, when the magnetic particles are spherical particles, the spherical magnetic particles with a mean grain diameter of 1 μm to 300 μm are mixed into the resin for an amount of 50 Vol % to 90 Vol % with respect to the resin, and when the magnetic particles are flat particles, the flat magnetic particles with a grain diameter of not more than 50 μm and with an aspect ratio of 10 or higher are mixed into the resin for an amount of 20 Vol % to 70 Vol % with respect to the resin.

2. The magnetic element according to claim 1, wherein the resin is a thermosetting resin.

3. The magnetic element according to claim 1, wherein the resin is a thermoplastic resin.

4. The magnetic element according to claim 1, wherein the magnetic particles are soft magnetism particles.

5. The magnetic element according to claim 4, wherein the soft magnetism particles are metal based magnetic particles.

6. The magnetic element according to claim 5, wherein the metal based magnetic particles are amorphous particles.

7. The magnetic element according to claim 1, wherein the magnetic part has a plurality of grooves.

* * * * *